US006610634B1

(12) United States Patent
Tiffany, III et al.

(10) Patent No.: US 6,610,634 B1
(45) Date of Patent: Aug. 26, 2003

(54) TWO-CYCLE LUBRICATING OIL

(75) Inventors: George Mortimer Tiffany, III, Princeton Junction, NJ (US); George Conrad L'Heureux, Scotch Plains, NJ (US); John Henry Smythe, Wantage (GB)

(73) Assignee: Exxon Chemical Patents Inc., DE (US)

( * ) Notice: Subject to any disclaimer, the term of this patent is extended or adjusted under 35 U.S.C. 154(b) by 0 days.

(21) Appl. No.: 08/807,210

(22) Filed: Feb. 28, 1997

Related U.S. Application Data

(63) Continuation of application No. 08/412,624, filed on Mar. 29, 1995, now abandoned.

(51) Int. Cl.[7] ..... C10M 101/00; C10M 111/00

(52) U.S. Cl. ..... 508/110; 208/14; 208/19; 585/2; 585/14

(58) Field of Search ..... 508/110, 390, 508/591; 44/300, 373, 435, 450; 585/2, 14; 208/15, 18, 19, 14, 16

(56) References Cited

U.S. PATENT DOCUMENTS

| | | | | | |
|---|---|---|---|---|---|
| 3,929,654 | A | * | 12/1975 | Brewster et al. | 252/48.2 |
| 3,953,179 | A | | 4/1976 | Souillard et al. | 44/58 |
| 4,075,113 | A | * | 2/1978 | Van Doorne | 508/534 |
| 4,663,063 | A | * | 5/1987 | Davis | 252/51.5 R |
| 4,705,643 | A | * | 11/1987 | Nemo | 252/51.5 A |
| 5,049,291 | A | | 9/1991 | Miyaji et al. | 252/33 |
| 5,308,524 | A | | 5/1994 | Miyaji et al. | 252/51.5 |
| 5,321,172 | A | | 6/1994 | Alexander et al. | 585/2 |
| 5,330,667 | A | | 7/1994 | Tiffany, III et al. | 252/49.6 |
| 5,498,353 | A | * | 3/1996 | Lin et al. | 508/189 |

FOREIGN PATENT DOCUMENTS

| | | |
|---|---|---|
| JP | 7409504 | 1/1974 |

* cited by examiner

*Primary Examiner*—Margaret Medley

(57) ABSTRACT

A two-cycle oil is disclosed consisting of a polybutene polymer, solvent and mineral oil which passes the JASO engine test for gasoline fueled two-cycle engines.

2 Claims, No Drawings

TWO-CYCLE LUBRICATING OIL

This is a continuation, of application Ser. No. 08/412,624 filed Mar. 29, 1995, abandoned.

This invention relates to a lubricant composition useful as a two-cycle oil. More particularly the invention relates to two-cycle oil characterized in that it has a significantly reduced additive content, but provides an oil which complies with certain test standards for land equipment, gasoline fueled, two-cycle engines, such as motorcycle engines, moped engines, snowmobile engines, lawn mower engines and the like. Two-stroke-cycle gasoline engines now range from small, less than 50 cc engines, to higher performance engines of 200 to 500 cc. The development of such high performance engines has created the need for new two-cycle oil standards and test procedures.

Two-cycle engines are lubricated by mixing the fuel and lubricant and allowing the mixed composition to pass through the engine. Various types of two-cycle oils, compatible with fuel, have been described in the art. Typically, such oils contain a variety of additive components in order for the oil to pass industry standard tests to permit use in two-cycle engines.

U.S. Pat. No. 5,330,667 issued Jul. 19, 1994 to Tiffany et al. discloses a multi-component two-cycle oil comprising an acylated polyamine, a polyalkylene polyamine—polyisobutylene succinic anhydride reaction product, a polyolefin, a sulfurized alkylphenol and a phosphorous containing anti-wear agent.

U.S. Pat. No. 3,953,179 issued Apr. 27, 1976 to Souillard et al. discloses a two-stroke oil composed of hydrogenated or non-hydrogenated polybutene or polyisobutylene having a molecular weight of 250 to 2,000, 0.5 to 10% by weight of a triglyceride of an unsaturated carboxylic acid and 3 to 10 % by weight of conventional additives.

U.S. Pat. No. 5,049,291 issued Sep. 17, 1991 to Miyaji et al. teaches a two-cycle oil made up of 40 to 90% of a polymer or copolymer being either ethylene or ethylene alpha olefin polymers, 0 to 50% by weight of a polybutene, 5 to 50% by weight of a hydrocarbonaceous solvent and 2 to 20% by weight of a lubricating oil additive for two-cycle engines.

U.S. Pat. No. 5,321,172 issued Jun. 14, 1994 to Alexander et al. discloses solvent-free two-cycle oils composed of two different types of basestocks, 3 to 15% by weight of a polyisobutylene of Mn 400 to 1050, 3 to 15% by weight of polyisobutylene of Mn 1150 to 1650. This reference discloses that solvents may be deleted, thereby avoiding the safety risk associated with such materials.

U.S. Pat. No. 5,308,524 discloses a two-cycle oil exhibiting good miscibility with gasoline and superiority in detergency composed of an ester of a hindered alcohol and a $C_5$–$C_{14}$ fatty acid, a polyoxyalkylene amino carbamate or an alkanol succinimide and a third component being a hydrocarbon having a boiling point of 500° or lower or an ether having an aromatic content of 2% below.

Japanese Kokai No. 7409504 published Jan. 28, 1974 discloses two-cycle engine oils which contain 5 to 50% by weight of a petroleum or synthetic hydrocarbon solvent and 10 to 95% by weight of a polyolefin having an average molecular weight of 200 to 200,000 and being soluble in the solvent. Such oils may also contain up to 40% by weight of a mineral oil. Three examples of the aforementioned publication shows polybutenes being present in amounts of 80%, 50% and 50% when the molecular weight is in the range of 570 to 1260 and another example shows the use of 30% polyisobutylene when the molecular weight is very high, that is, 100,000. The present invention is considered distinguished from this reference in that the polybutene used must be present in a very narrow range of 25 to 35% by weight and the molecular weight is only within the range of 300 to 1500.

The present invention is based on the discovery that the proper balance of a polybutene polymer, solvent and mineral oil can provide a two-cycle engine oil suitable for air-cooled two-stroke engines used commonly for land equipment. This invention avoids the need for complex and expensive additive systems.

Accordingly, there has been discovered a two-cycle lubricating oil composition having a viscosity of 6.5–14 cSt at 100° C. and a flash point greater than 70° C. consisting of:

a) 25 to 35% by weight of a polybutene polymer being a polybutene, polyisobutylene or a mixture of polybutenes and polyisobutylenes having a number average molecular weight of about 300 to 1500;

b) 20 to 35% by weight of a normally liquid solvent having a boiling point of up to 300° C.;

c) 30 to 40% by weight of a lubricating oil having a viscosity 20–40 cSt at 40° C.; and d) 0–2% by weight of lubricating oil additives other than a polybutene.

The mixture of polybutenes preferably useful in the lubricating oil compositions of this invention is a mixture of poly-n-butenes and polyisobutylene which normally results from the polymerization of $C_4$ olefins and generally will have a number average molecular weight of about 300 to 1500 with a polyisobutylene or polybutene having a number average molecular weight of about 400 to 1300 being particularly preferred, most preferable is a mixture of polybutene and polyisobutylene having a number average molecular weight of about 950. Number average molecular weight (Mn) is measured by gel permeation chromatography. Polymers composed of 100% polyisobutylene or 100% poly-n-butene are also within the scope of this invention and within the meaning of the term "a polybutene polymer".

A preferred polybutene polymer is a mixture of polybutenes and polyisobutylene prepared from a $C_4$ olefin refinery stream containing about 6 wt.% to 50 wt.% isobutylene with the balance a mixture of butene (cis- and trans-) isobutylene and less than 1 wt %. butadiene. Particularly, preferred is a polymer prepared from a $C_4$ stream composed of 6–45 wt. % isobutylene, 25–35 wt. % saturated butenes and 15–50 wt.% 1- and 2-butenes. The polymer is prepared by Lewis acid catalysis.

The solvents useful in the present invention may generally be characterized as being normally liquid petroleum or synthetic hydrocarbon solvents having a boiling point not higher than about 300° C. at atmosphere pressure. Such a solvent must also have a flash point in the range of about 60–120° C. such that the flash point of the two-cycle oil of this invention is greater than 70° C. Typical examples include kerosene, hydrotreated kerosene, middle distillate fuels, isoparaffinic and naphthenic aliphatic hydrocarbon solvents, dimers, and higher oligomers of propylene butene and similar olefins as well as paraffinic and aromatic hydrocarbon solvents and mixtures thereof. Such solvents may contain functional groups other than carbon and hydrogen provided such groups do not adversely affect performance of the two-cycle oil. Preferred is a naphthenic type hydrocarbon solvent having a boiling point range of about 91.1° C.–113.9° C. (196°–237° F.) sold as "Exxsol D80" by Exxon Chemical Company.

The third component of the lubricating compositions of this invention is an oil of lubricating viscosity, that is, a viscosity of about 55–180 cSt at 40° C., to provide a finished two-cycle oil in the range of 6.5–14 cSt at 100° C.

These oils of lubricating viscosity for this invention can be natural or synthetic oils. Mixtures of such oils are also often useful. Blends of oils may also be used so long as the final viscosity is 55–180 cSt at 40° C.

Natural oils include mineral lubricating oils such as liquid petroleum oils and solvent-treated or acid-treated mineral lubricating oils of the paraffinic, naphthenic or mixed paraffinic-naphthenic types. Oils of lubricating viscosity derived from coal or shale are also useful base oils.

Synthetic lubricating oils include hydrocarbon oils such as polymerized and interpolymerized olefins alkylated diphenyl ethers and alkylated diphenyl sulfides and the derivatives, analogs and homologs thereof.

Oils made by polymerizing olefins of less than 5 carbon atoms and mixtures thereof are typical synthetic polymer oils. Methods of preparing such polymer oils are well known to those skilled in the art as is shown by U.S. Pat. Nos. 2,278,445; 2,301,052; 2,318,719; 2,329,714; 2,345,574; and 2,422,443.

Alkylene oxide polymers (i.e., homopolymers, interpolymers, and derivatives thereof where the terminal hydroxyl groups have been modified by esterification, etherification, etc.) constitute a preferred class of known synthetic lubricating oils for the purpose of this invention, especially for use in combination with alkanol fuels. They are exemplified by the oils prepared through polymerization of ethylene oxide or propylene oxide, the alkyl and aryl ethers of these polyoxyalkylene polymers (e.g., methyl polypropylene glycol ether having an average molecular weight of 1000, diphenyl ether of polyethylene glycol having a molecular weight of 500–1000, diethyl ether of polypropylene glycol having a molecular weight of 1000–1500, etc.) or mono-and polycarboxylic esters thereof, for example, the acetic acid esters mixed $C_3$–$C_8$ fatty acid esters, or the $C_{13}$ Oxo acid diester of tetraethylene glycol.

Another suitable class of synthetic lubricating oils comprises the esters of dicarboxylic acids (e.g., phthalic acid, succinic acid, alkyl succinic acids, alkenyl succinic acids, maleic acid, azelaic acid, suberic acid, sebacic acid, fumaric acid, adipic acid, linoleic acid dimer, malonic acid, alkyl malonic acids, alkenyl malonic acids, etc.) with a variety of alcohols (e.g., butyl alcohol, hexyl alcohol, octyl alcohol, dodecyl alcohol, tridecyl alcohol, 2-ethylhexyl alcohol, ethylene glycol, diethylene glycol monoether, propylene glycol, etc.). Specific examples of these esters include dioctyl adipate, di(2-ethylhexyl)sebacate, di-n-hexyl fumarate, dioctyl sebacate, diisoctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid and the like.

Esters useful as synthetic oils also include those made from $C_5$ to $C_{18}$ monocarboxylic acids and polyols and polyol ethers such as neopentyl glycol, trimethylol propane, pentaerythritol, dipentaerythritol, tripentaerythritol, etc.

Unrefined, refined and rerefined oils, either natural or synthetic (as well as mixtures of two or more of any of these) of the type disclosed hereinabove can be used in the lubricant compositions of the present invention. Unrefined oils are those obtained directly from a natural or synthetic source without further purification treatment. For example, a shale oil obtained directly from retorting operations, a petroleum oil obtained directly from primary distillation or an ester oil obtained directly from an esterification process and used without further treatment would be an unrefined oil. Refined oils are similar to the unrefined oils except they have been further treated in one or more purification steps to improve one or more properties. Many such purification techniques are known to those of skill in the art such as solvent extraction, secondary distillation, acid or base extraction, filtration, percolation, etc. Rerefined oils are obtained by processes similar to those used to obtain refined oils which have been already used in service. Such rerefined oils are also known as reclaimed or reprocessed oils and often are additionally processed by techniques directed to removal of spent additives and oil breakdown products.

The present invention is based on the discovery that the use of these three components in certain critical ranges of proportions is effective in providing an oil which meets the new JASO (Japanese Automobile Standards Organization) engine oil test for two-cycle lube oil compositions for two-stroke engines used in land equipment. Applicants have discovered that balancing these proportions in the manner set forth herein obviates the need for other additives in amounts heretofore normally considered necessary to pass engine tests, such as the JASO Two-cycle Oil Standards discussed in detail in the examples below. This standard was established to meet the needs associated with recent development of high power, two-cycle engines. Accordingly, the preferred composition of this invention contains about 28–32%, such as 30% of polybutenes, 26–30%, such as 28% of solvent and 40–44%, such as 42% of mineral oil of lubricating viscosity.

The invention further comprises the presence of up to 2% by weight of another special purpose conventional lubricating oil additive, which is not a polybutene, but may be any additive normally included in lubricating oils for a particular purpose.

The presence of an additional additive or additives in total amounts between 0 and 2% such as about 0.5 to 2% or 1.0 to 1.5 wt. %, may be necessary to pass the more stringent engine oil tests or for another special purpose, but such amounts are substantially below what is normally considered a minimum requirement for such two-cycle oil compositions.

Additional conventional additives for lubricating oils which may be present in the composition of this invention include viscosity modifiers, corrosion inhibitors, oxidation inhibitors, friction modifiers, dispersants, antifoaming agents, antiwear agents, pour point depressants, detergents, rust inhibitors and the like.

Typical oil soluble viscosity modifying polymers will generally have weight average molecular weights of from about 10,000 to 1,000,000 as determined by gel permeation chromatography.

Corrosion inhibitors are illustrated by phosphosulfurized hydrocarbons and the products obtained by reacting a phosphosulfurized hydrocarbon with an alkaline earth metal oxide or hydroxide.

Oxidation inhibitors are antioxidants exemplified by alkaline earth metal salts of alkylphenol thioesters having preferably $C_5$–$C_{12}$ alkyl side chain such as calcium nonylphenol sulfide, barium t-octylphenol sulfide, dioctylphenylamine as well as sulfurized or phospho sulfurized hydrocarbons. Also included are oil soluble antioxidant copper compounds such as copper salts of $C_{10}$ to $C_{18}$ oil soluble fatty acids.

Friction modifiers include fatty acid esters and amides, glycerol esters of dimerized fatty acids and succinate esters or metal salts thereof.

Dispersants are well known in the lubricating oil field and include high molecular weight alkyl succinimides being the reaction products of oil soluble polyisobutylene succinic anhydride with ethylene amines such as tetraethylene pentamine and borated salts thereof.

Pour point depressents also known as lube oil flow improvers can lower the temperature at which the fluid will flow and typical of these additives are $C_8$–$C_{18}$ dialkyl fumarate vinyl acetate copolymers, polymethacrylates and wax naphthalene.

Foam control can also be provided by an anti foamant of the polysiloxane type such as silicone oil and polydimethyl siloxane.

Anti-wear agents reduce wear of metal parts and representative materials are zinc dialkyldithiophosphate and zinc diaryl diphosphate.

Detergents and metal rust inhibitors include the metal salts of sulfonic acids, alkylphenols, sulfurized alkylphenols, alkyl salicylates, naphthenates and other oil soluble mono and dicarboxylic acid. Neutral or highly basic metal salts such as highly basic alkaline earth metal sulfonates (especially calcium and magnesium salts) are frequently used as such detergents. Also useful is nonylphenol sulfide. Similar materials made by reacting an alkylphenol with commercial sulfur dichlorides. Suitable alkylphenol sulfides can also be prepared by reacting alkylphenols with elemental sulfur.

Also suitable as detergents are neutral and basic salts of phenols, generally known as phenates, wherein the phenol is generally an alkyl substituted phenolic group, where the substituent is an aliphatic hydrocarbon group having about 4 to 400 carbon atoms.

The presence of such additives is not essential to pass the JASO M345 test referred to herein below but such additives may be desirable or necessary to further enhance performance of the oils for specific applications. Thus, the invention considers the presence of such additives, in total amounts of 2% by weight to be within the scope of this invention, since, prior to the present invention, amounts in excess of 2% have been considered essential to comply with industry standards.

The lubricating oil compositions of the present invention will mix freely with the fuels used in such two-cycle engines. Admixtures of such lubricating oils with fuels comprise a further embodiment of this invention. The fuels useful in two-cycle engines are well known to those skilled in the art and usually contain a major portion of a normally liquid fuel such as a hydrocarbonaceous petroleum distillate fuel, e.g., motor gasoline is defined by ASTM specification D-439-73. Such fuels can also contain non-hydrocarbonaceous materials such as alcohols, ethers, organo nitro compounds and the like, e.g., methanol, ethanol, diethyl ether, methylethyl ether, nitro methane and such fuels are within the scope of this invention as are liquid fuels derived from vegetable and mineral sources such as corn, alpha shale and coal. Examples of such fuel mixtures are combinations of gasoline and ethanol, diesel fuel and ether, gasoline and nitro methane, etc. When gasoline is used as preferred than the mixture of the hydrocarbons having an ASTM boiling point of 60° C. at the 10% distillation point to about 205° C. at the 90% distillation point.

The lubricants of this invention are used in admixture with fuels in amounts of about 20 to 250 parts by weight of fuel per 1 part by weight of lubricating oil, more typically about 30–100 parts by weight of fuel per 1 part by weight of oil.

The invention is further illustrated by the following examples which are not to be considered as limitative of its scope.

EXAMPLES

Three oils were evaluated in accordance with the JASO M345 test procedures JASO M340, M341, M342 and M343. This is in engine test established by society of Automotive Engineers of Japan (JSAE) for two-cycle gasoline engine oils. As of Jul. 1, 1994, oils used in two-cycle engines are being labeled in accordance with the JASO-M345 standards as announced by the Japan Automobile Standards Organization (JASO). JASO published the JASO M345 standards in April 1994.

The following oils were tested (all percentages are by weight):

Oil A: 30% mixed polybutenes of Mn 950
- 27.25% "Exxsol D80" solvent, a napehthenic aliphatic hydrocarbon solvent having a b.p. 91.1–113.9° C.
- 15.48% solvent 150 neutral, a mineral oil of viscosity 30.3 cSt at 40° C. (150 S.U.S. at 37.8° C.).
- 27.27% solvent 600 neutral, a mineral oil of viscosity 113 cSt at 40° C. (600 S.U.S. at 37.8° C.).

Oil B: Same as Oil A except 25% Exxsol D80, 25% solvent 600 neutral mineral oil, 4.49% of a dispersant and detergent additives and 0.03% benzotriazole (dissolved in propylene glycol) anti-rust agent. Oil B therefore has 4.52% by weight special purpose additive besides the same polybutene, solvent and mineral oil as Oil A.

Oil C: Same as Oil B except 2.24% dispersant and detergent additives and 0.015% anti-rust agent. Oil C therefore has 2.26% by weight special purpose additives besides the three basic ingredients of Oil A. The detergents and dispersants in Oil C were the same as Oil B.

Oil A is the oil of the invention; Oils B and C are for comparative purposes and show the effect of adding additives, other than the three main components, in amounts totaling more than 2% by weight.

Oil A has a viscosity of 6.96 cSt at 100° C and a flash point of 92° C.

Engine Test Results - JASO M345 & ISO-EGD

| | JASO M345 | | | | |
|---|---|---|---|---|---|
| Oil | A | B | C | Standard-FC Minimum | ISO-EGD Minimum |
| EGD Detergency | 137 | 130/126 | 110 | — | 125 |
| JASO Detergency M341 | 111 | 111 | 121 | 95 | — |
| JASO Lubricity M340 | 107 | 103 | 102 | 95 | 95 |
| JASO Torque M340 | 99.1 | 100 | 100 | 98 | 98 |
| JASO Blocking M343 | 237 | 110/114 | 166 | 90 | 90 |
| JASO Smoke M342 | 94 | 101/111 | 91 | 85 | 85 |

The unexpected advantages offered by Oil A, which has no special purpose additive, are illustrated by the "EGD Detergency" which is a reference to a further modification of the normal JASO M341 detergency test (1 hour) procedure in which the test is run for 3 hours. This is a more stringent standard expected to be adopted by ISO (the International Organization for Standardization) as published by Committee Draft of Jan. 5, 1995 of Technical Committee 28. "FC" is the highest performance standard for the JASO M345 standards.

Oil A exhibits excellent results with respect to exhaust port blocking and is generally superior to Oils B and C in all categories of the test. Oil A is therefore significantly better in terms of both its cost and its performance.

What is claimed is:

1. A fuel-lubricant composition consisting essentially of about 20–250 parts by weight of a fuel suitable for a two-cycle engine per 1 part by weight of a two-cycle engine oil having a viscosity of 6.5–14 cSt at 100° C. and a flash point greater than 70° C.

a) 28–32% by weight of a mixture of poly-n-butenes and polyisobutylene having a number average molecular weight of about 300 to 1500;

b) 26–30% by weight of a normally liquid naphthenic aliphatic solvent having a boiling point of up to 300° C.; and c) 42–44% by weight of a lubricating oil having a viscosity 55–180 cSt at 40° C.

2. The composition of claim 1 wherein the mixture has a number average molecular weight of about 400 to 1300.

* * * * *